US008978321B1

(12) United States Patent
Peck et al.

(10) Patent No.: US 8,978,321 B1
(45) Date of Patent: Mar. 17, 2015

(54) SNAP LOCK SOFFIT SYSTEM

(71) Applicant: MarPec, Inc., Cedar Rapids, IA (US)

(72) Inventors: Robert William Peck, Cedar Rapids, IA (US); Mark William Loughren, Mt. Vernon, IA (US)

(73) Assignee: Marpec, Inc., Cedar Rapids, IA (US)

( * ) Notice: Subject to any disclaimer, the term of this patent is extended or adjusted under 35 U.S.C. 154(b) by 0 days.

(21) Appl. No.: 14/498,671

(22) Filed: Sep. 26, 2014

Related U.S. Application Data

(60) Provisional application No. 61/882,802, filed on Sep. 26, 2013.

(51) Int. Cl.

| | |
|---|---|
| ***E04B 7/00*** | (2006.01) |
| ***E04D 3/40*** | (2006.01) |
| ***E04D 13/00*** | (2006.01) |
| ***E04C 2/38*** | (2006.01) |
| ***E04F 13/08*** | (2006.01) |
| ***E04F 13/076*** | (2006.01) |

(52) U.S. Cl.
CPC ..... *E04C 2/38* (2013.01); *E04F 13/0801* (2013.01); *E04F 13/076* (2013.01)
USPC ..... 52/94

(58) Field of Classification Search
USPC ..... 52/22, 94–97; 248/48.1
See application file for complete search history.

(56) References Cited

U.S. PATENT DOCUMENTS

| | | | | |
|---|---|---|---|---|
| 4,195,455 | A * | 4/1980 | Chalmers et al. | 52/94 |
| 4,347,691 | A * | 9/1982 | Lloyd-Jones | 52/95 |
| 5,243,793 | A * | 9/1993 | MacLeod et al. | 52/95 |
| 2005/0166529 | A1* | 8/2005 | Rodolofo et al. | 52/716.1 |
| 2005/0193671 | A1* | 9/2005 | Brochu et al. | 52/506.01 |
| 2007/0107320 | A1* | 5/2007 | Brochu et al. | 52/22 |
| 2010/0212234 | A1* | 8/2010 | Monteer | 52/95 |
| 2012/0102849 | A1* | 5/2012 | Shugart | 52/96 |

* cited by examiner

*Primary Examiner* — Brian Glessner
*Assistant Examiner* — Brian D Mattei
(74) *Attorney, Agent, or Firm* — Richards Patent Law P.C.

(57) ABSTRACT

A snap lock soffit system includes: a receiver rail including; a receiver rail flange; an end fastening tab located at one end of the receiver rail; and a plurality of snap lock receiver tabs depending from the receiver rail, the snap lock receiver tabs being spaced along the length of the receiver rail flange; and a soffit panel including: a plurality of retainer grooves each adapted to receive a corresponding snap lock receiver tab in a press fit locking configuration to secure the soffit panel to the receiver rail, the retainer grooves spaced along the length of the soffit panel; a fastening edge located at a first end along the length of the soffit panel, where in the fastening edge is aligned with the plane of the end fastening tab of the receiver rail when the soffit panel is secured to the receiver rail; and a soffit extension.

7 Claims, 5 Drawing Sheets

SNAP LOCK SOFFIT SYSTEM

CROSS-REFERENCE TO RELATED APPLICATIONS

This application incorporates by reference and claims the benefit of priority to U.S. Provisional Application 61/882,802 filed on Sep. 26, 2013.

BACKGROUND OF THE INVENTION

The present subject matter relates generally to a snap lock soffit system. More specifically, the present invention relates to a plastic exterior soffit system that includes a simple snap locking fastener system to assist in installation.

As used herein, the term soffit generally refers to the exposed undersurface of an exterior overhanging section of a roof eave. However, it is understood that the term soffit, and the subject matter presented herein, applies to the underside of porches, arches, columns, stairs, etc.

In residential and commercial construction, the soffit is typically protected by one or more layers of material (aluminum, vinyl, wood, etc.), often screwed or nailed into position. The soffit is both functional and aesthetic. Functionally, the soffit protects the rafters from the weather. A ventilated soffit also allows appropriate airflow through the exterior of the building envelope. This can be useful in preventing moisture (and the accompanying rotting and mold) from accumulating along the interior of the building envelope. Aesthetically, the soffit provides a clean and coherent look to otherwise exposed undersurfaces of the building.

Due to its location and orientation, soffits can be awkward to install and maintain. Current soffit solutions have not integrated the fastening system into the design of the soffit panels, which then requires several accessory pieces to be used to fasten the soffit panels in place. Furthermore, the soffit panels are typically installed perpendicular to the direction of the overhang and need to be cut into many smaller pieces prior to installation. For these reasons and others, soffits can be time consuming and difficult to install and maintain.

Accordingly, there is a need for a soffit system that is easier and quicker to install, as described herein.

BRIEF SUMMARY OF THE INVENTION

To meet the needs described above and others, the present disclosure provides a soffit system that is simple to install and can be installed without requiring the additional accessory pieces that current systems need to complete installation. At the most general description, the snap lock soffit system includes a snap lock receiver rail that facilitates the system's snap lock functions, a plurality of snap fit soffit panels, and optional trim.

In an exemplary embodiment of the soffit system, a snap lock receiver rail is installed horizontally between the sub fascia and the face of the exterior wall at a predetermined spacing. The snap lock receiver rail includes a plurality of snap lock receiver tabs onto which the soffit panels are snapped by simply pushing the soffit panels upward onto the snap lock receiver tabs. Because the soffit panels run parallel to the eave, less cutting and fitting is required, which significantly reduces the installation time required. An optional trim piece can be installed to make the transition between the soffit and the siding more aesthetically pleasing. To simplify the eave even further, an optional gutter system can be added eliminating the need for a sub-fascia.

In one embodiment, a snap lock soffit system includes: a receiver rail including; a receiver rail flange whose length and height define a first plane; an end fastening tab located at one end of the receiver rail whose width and height defines a second plane, wherein the first plane and second plane are perpendicular to each other, the end fastening tab including at least one fastening hole; and a plurality of snap lock receiver tabs depending from the receiver rail, the snap lock receiver tabs being spaced along the length of the receiver rail flange; and a soffit panel including: a plurality of retainer grooves each adapted to receive a corresponding snap lock receiver tab in a press fit locking configuration to secure the soffit panel to the receiver rail, the retainer grooves spaced along the length of the soffit panel; a fastening edge located at a first end along the length of the soffit panel, where in the fastening edge is aligned with the plane of the end fastening tab of the receiver rail when the soffit panel is secured to the receiver rail; and a soffit extension panel retainer groove located at a second end along the length of the soffit panel.

In one contemplated embodiment, the receiver rail flange includes a radiused end opposite to the end fastening tab and the length of the receiver rail extends past the length of the radiused end. In this embodiment, at least one receiver tab may depend from the receiver rail at a position further from the end fastening tab than the radiused end.

In another contemplated embodiment, the snap lock soffit system further includes an end hanger located the end of the receiver rail opposite to the end fastening tab, wherein the end hanger's width and height defines a third plane, where in the first plane and third plane are perpendicular to each other and the second plane and third plane are parallel to each other, the end hanger including at least one fastening hole.

The soffit panel may further include a frieze trim retainer groove for mating with a frieze trim.

An object and advantage of the soffit system is to provide a soffit installation solution that is simple and faster to install.

Another object and advantage of the soffit system is to hold the soffit panels securely in to the snap lock receiver rail while allowing them to float freely with respect to each other so as to be better suited for expansion and contraction between soffit panels with the changing of the weather.

Yet another object and advantage of the invention is to provide a system that is appropriate for installation across a variety of eaves locations and flexible enough to be installed without alterations on the majority of eave configurations.

Another advantage of the snap lock soffit system is that when installed with its optional gutter system, it becomes a complete installation from the drip edge of the roof to the top transition at the siding.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
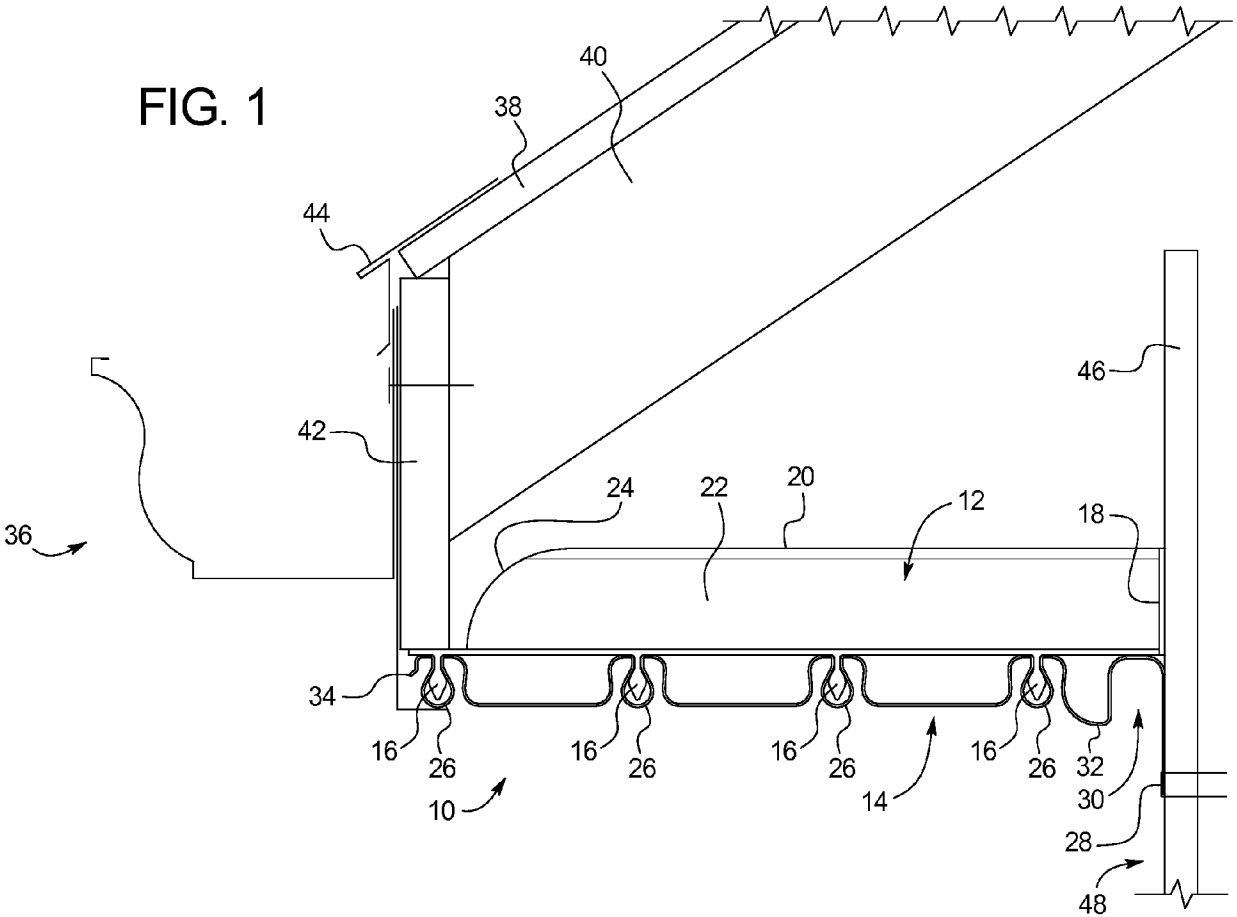
FIG. 1 is a cross-sectional side view of a snap lock soffit system embodying the teachings of the present disclosure.

FIG. 1 illustrates an embodiment of a snap lock soffit system 10 installed at the undersurface of an exterior overhanging section of a roof eave. As shown in FIG. 1, the snap lock soffit system 10 includes a snap lock receiver rail 12 and a soffit panel 14. As shown, the receiver rail 12 includes a series of snap lock receiver tabs 16, an end fastening tab 18, a stiffening flange 20, a receiver rail flange 22, and a radiused end 24. The soffit panel 14 includes a series of retainer grooves 26 corresponding to the receiver tabs 16, a fastening edge 28, a J channel 30, a decorative edge 32, and a soffit extension panel retainer groove 34. This embodiment of the soffit system 10 is intended to be installed in combination with a standard gutter and facia cover system 36. Accordingly, the other contextual elements shown in FIG. 1 include roof sheathing 38, a truss tail 40, sub-fascia 42, a standard drip edge 44, and wall sheathing 46.

The construction shown in FIG. 1 is a standard 12" eave construction. FIG. 1 shows how the snap lock receiver rail 12 is fastened between the sub-fascia 42 and the exterior wall construction 48 using a fastener (i.e., nail or screw, not shown) installed through the end fastening tab 18 and the wall sheathing 46. The soffit panel 14 is then snapped on to the receiver rail 12. The radiused end 24 of the receiver rail 12 enables the receiver rail 12 to fit comfortably under the truss tail 40 and short of the sub-fascia 42. The stiffening flange 20 and receiver rail flange 22 provide the structural support for the receiver tabs 16, which in turn support the soffit panel 14. As shown, the fastening edge 28 mates with the wall sheathing 46, the J channel 30 provides a channel into which the building's siding (not shown) may mate with the soffit panel 14, and the decorative edge 32 may provide an aesthetically pleasing transition between the soffit panel 14 and the siding.

One skilled in the art of eave and soffit construction will readily recognize that a series of receiver rails 12 may be installed along the length of the eave construction to provide a corresponding number of connection points for one or more soffit panels 14. The soffit panels 14 may overlap each other, enabling a free range of lateral movement between adjacent soffit panels 14, which prevents warping or other damage that can occur when adjacent soffit panels 14 are unable to move with respect to each other. This also provides a very quick and easy installation process in that the soffit panels 14 do not need to be cut to size or otherwise manipulated for installation.

Figure 2:
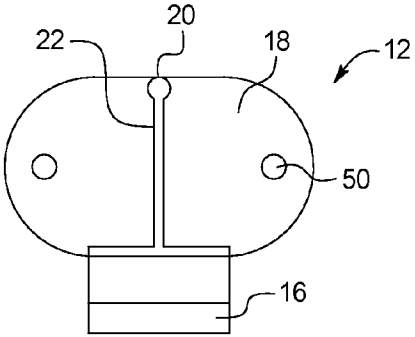
FIG. 2 is a cross-sectional side view of a snap lock receiver rail for use in the snap lock soffit system shown in FIG. 1.
Figure 3:
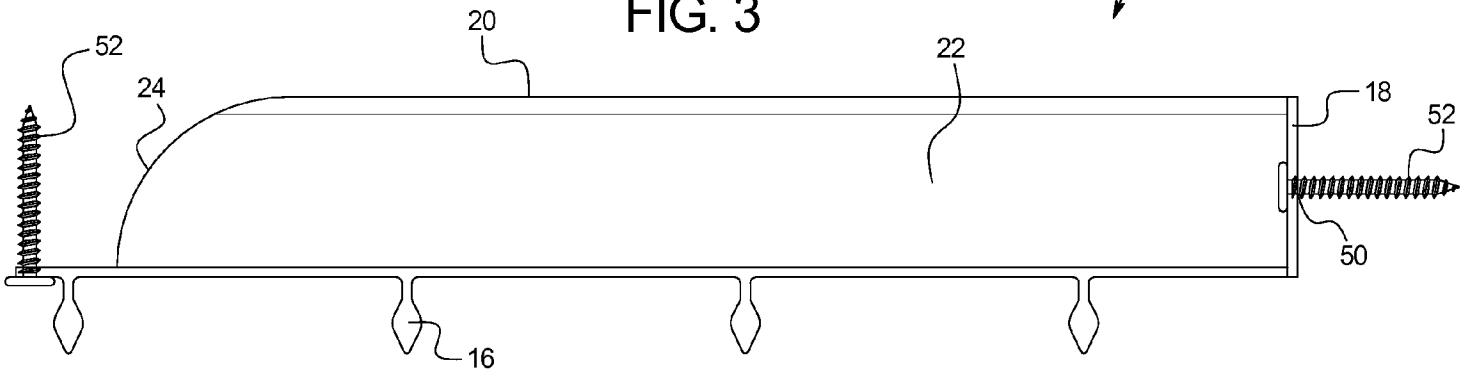
FIG. 3 is an elevation side view of the snap lock receiver rail shown in FIG. 2.

FIGS. 2 and 3 show additional details of the receiver rail 12 shown in FIG. 1. FIG. 2 shows the receiver rail 12 rotated 90 degrees from its position in FIG. 1. As shown, the receiver rail 12 includes the elements shown in FIG. 1 (snap lock receiver tabs 16, an end fastening tab 18, a stiffening flange 20, a receiver rail flange 22) as well as one or more fastening holes 50 to enable the end fastening tab 18 to easily be secured to the wall sheathing 46 using a screw or similar fastener 52. In FIG. 3, a fastener 52 is shown through the end fastening tab 18.

Figure 4:
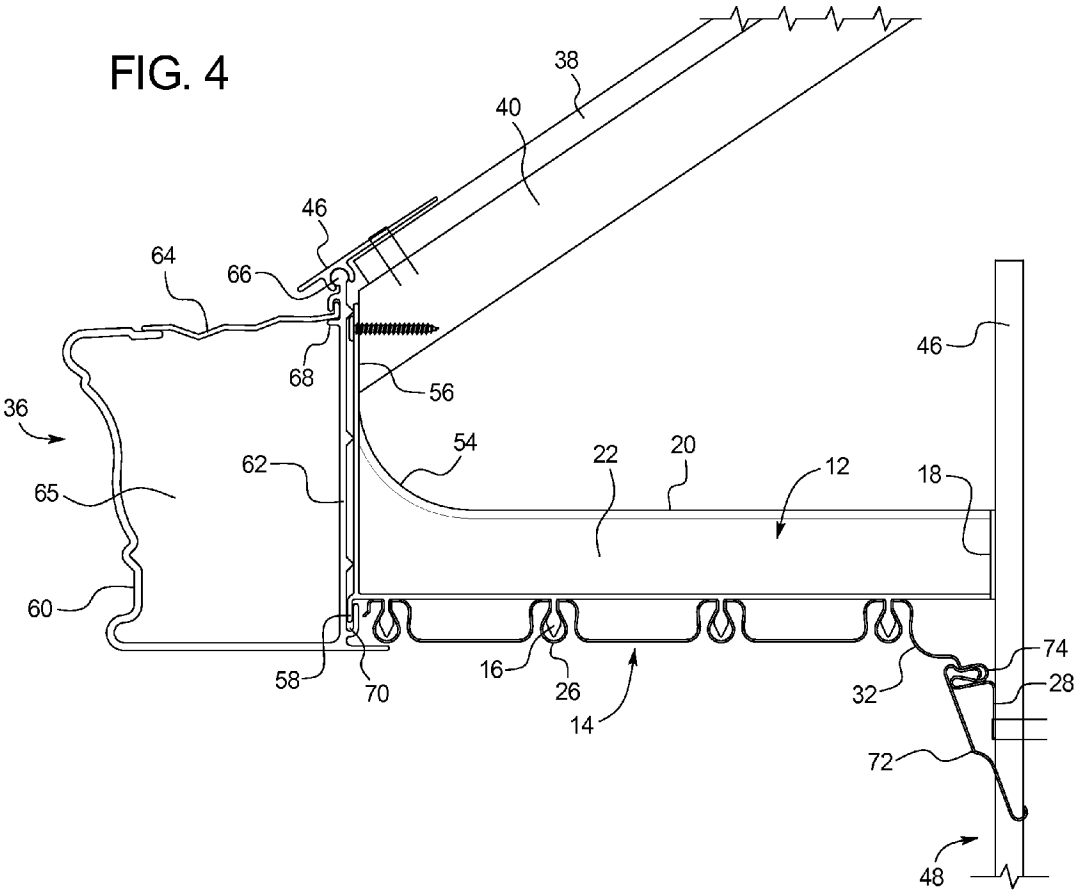
FIG. 4 is a cross-sectional side view of the snap lock soffit system of FIG. 1 mated to a gutter system to provide a complete installation from the roof's drip edge to the siding transition along the face of the building.

FIG. 4 illustrates an alternative embodiment of the receiver rail 12. As shown in FIG. 4, the soffit system 10 mates to a gutter system 36 to provide a complete installation from the roof's drip edge 44 to the siding transition along the face of the building. The receiver rail 12 differs from that shown in FIGS. 1-3 and is further illustrated in FIG. 5.

Figure 5:
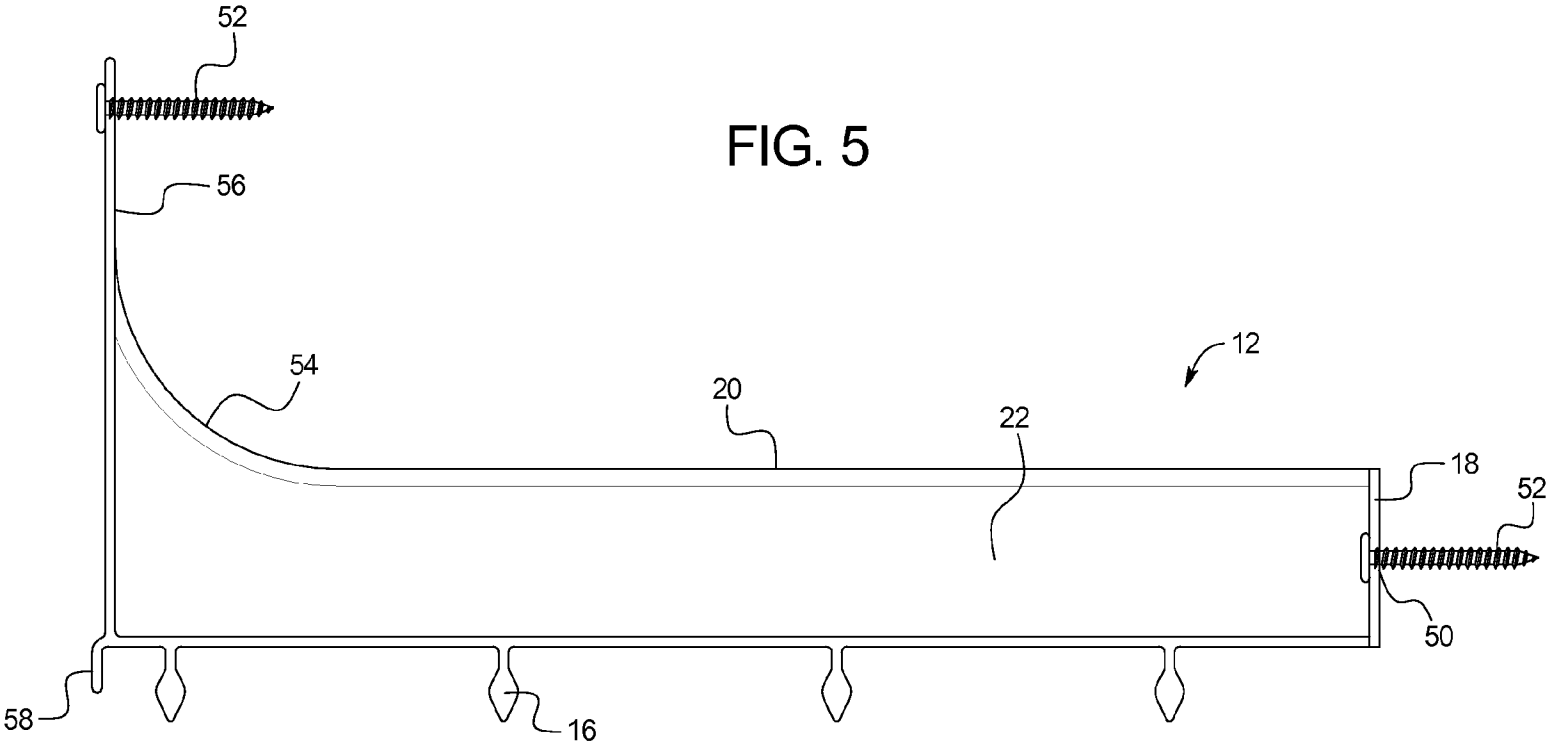
FIG. 5 is an elevation side view of the snap lock receiver rail shown in FIG. 4.

As shown in FIGS. 4 and 5, this embodiment of the receiver rail 12 includes a radiused stiffening flange 54 that connects to an end hanger 56 and further includes a gutter retainer tab 58. This configuration of the soffit system 10 eliminates the need for the sub-fascia 42 shown in FIG. 1. This configuration of the soffit system 10 also is adapted to mate with a gutter system 34. The gutter system 36 shown in FIG. 4 is the gutter system taught in U.S. Pat. No. 8,549,791, which is incorporated herein by reference in its entirety.

As shown in FIG. 4, the receiver rail 12 may be installed by fastening the end hanger 56 to the truss tail 40 and by fastening the end fastening tab 18 to the wall sheathing 46. Then, the drip edge 46 may be secured to the roof sheathing 38 such that the gutter system 36 can be connected to the retaining rail 12 and the drip edge 46.

The gutter system 36 shown in FIG. 4 includes a gutter body 60, including a gutter back wall 62 and a gutter guard 64, protecting the gutter channel 65. A pivot joint 66 is formed by the mating of the drip edge 46 and the gutter back wall 62 spans the end hanger 56 to interface with the gutter retainer tab 58 at a lower matting portion 70. This is merely one example of a gutter system 36 that may be integrated with the soffit system 10 and other variations of appropriate gutter systems 36 will be apparent to those skilled in the art based on the disclosure provided herein including the incorporation by reference of U.S. Pat. No. 8,549,791.

As further shown in FIG. 4, the soffit panel 14 mates with a frieze trim 72 at a frieze trim retainer groove 74. This enables a snap-fit connection between the frieze trim 72 and the soffit panel 14. The frieze trim 72 completes the span from the drip edge 46 to the exterior wall construction 48. The frieze trim 72 is designed in such a way that it binds with the soffit panel 14 and forces the bottom edge of the frieze trim 72 tight against the siding below. As a result, the soffit system 14 in connection with the gutter system 36 provides an integrated solution for constructing eaves, particularly without the need for sub-facia 42.

Figure 6:
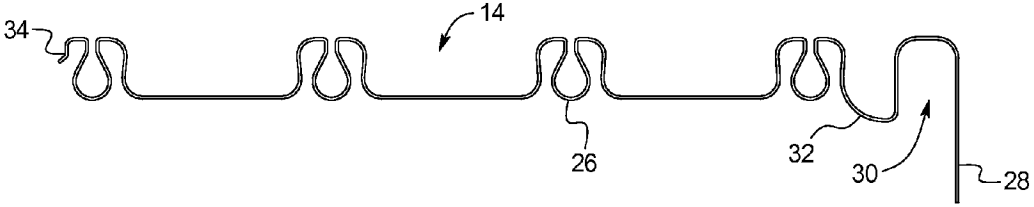
FIG. 6 is a cross-sectional side view of a soffit panel with a J channel.

FIGS. 6-9 show various embodiments of the soffit panel 14 and frieze trim 72. FIG. 6 is an example of a soffit panel 14 with a J channel 30. The J channel 30 may make it easier to mate the soffit panel 14 with the siding of the building.

Figure 7:
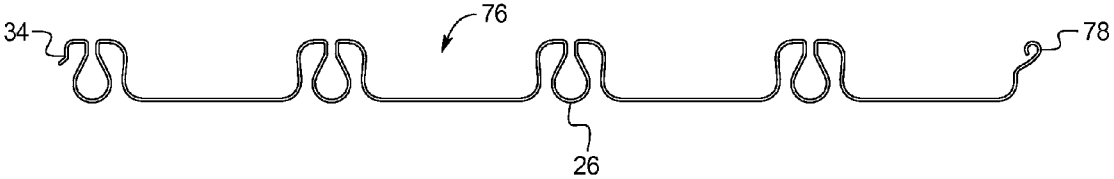
FIG. 7 is a cross-sectional side view of a soffit panel extension.

FIG. 7 is an example of a soffit extension panel 76 that includes a snap bulb 78 that mates with the soffit extension panel retainer groove 34 to join the soffit panel 14 and the soffit extension panel 76 together in a snap-fit manner. Because the soffit extension panel 76 also includes a soffit extension panel retainer groove 34, additional soffit extension panels 76 may be linked to form an even larger span of soffit panels 14 and soffit extension panels 76.

Figure 8:
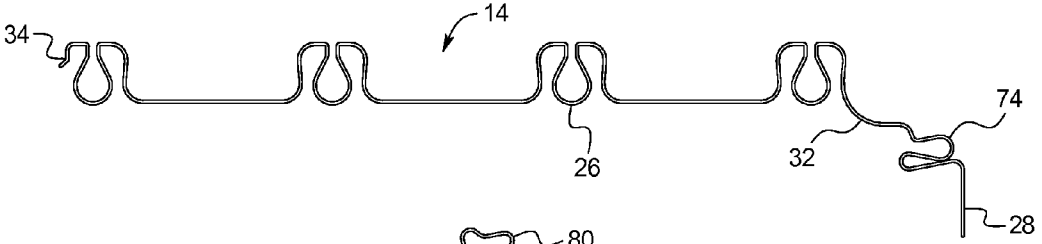
FIG. 8 is a cross-sectional side view of a soffit panel with a frieze trim receiver.
Figure 9:
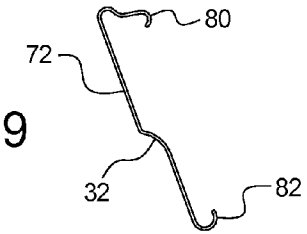
FIG. 9 is a cross-sectional side view of frieze trim that mates with the soffit panel with a frieze trim receiver shown in FIG. 8.

FIG. 8 is an example of a soffit panel 14 with a frieze trim retainer groove 74 and FIG. 9 is an example of a frieze trim 72. As shown, the frieze trim 72 includes a male snap end 80 that mates with the frieze trim retainer groove 74 and a bottom edge 82 that is to be placed in tension against the siding below, when installed. The frieze trim 72 further includes a decorative edge 32. The shape of the frieze trim 72 shown in FIG. 9 is merely one of countless examples of frieze trim 72 that could be used. The key factors are the male snap end 80, the aesthetic body (e.g., the decorative edge 32), and the bottom edge 82.

While not shown explicitly, the soffit panels 14 may be perforated other otherwise ventilated to provide appropriate attic (or other) ventilation.

It should be noted that various changes and modifications to the embodiments described herein will be apparent to those skilled in the art. Such changes and modifications may be made without departing from the spirit and scope of the present invention and without diminishing its attendant advantages. For example, various embodiments of the method and portable electronic device may be provided based on various combinations of the features and functions from the subject matter provided herein.

We claim:

1. A snap lock soffit system comprising:

a receiver rail including;

a receiver rail flange whose length and height define a first plane;

an end fastening tab located at one end of the receiver rail whose width and height defines a second plane, wherein the first plane and second plane are perpendicular to each other, the end fastening tab including at least one fastening hole; and a plurality of snap lock receiver tabs depending from the receiver rail, the snap lock receiver tabs being spaced along the length of the receiver rail flange; and a soffit panel including:

a plurality of retainer grooves each adapted to receive a corresponding snap lock receiver tab in a press fit locking configuration to secure the soffit panel to the receiver rail, the retainer grooves spaced along the length of the soffit panel;

a fastening edge located at a first end along the length of the soffit panel, wherein the fastening edge is aligned with the plane of the end fastening tab of the receiver rail when the soffit panel is secured to the receiver rail; and a soffit extension panel retainer groove located at a second end along the length of the soffit panel.

2. The snap lock soffit system of claim 1 wherein the receiver rail flange includes a radiused end opposite to the end fastening tab.

3. The snap lock soffit system of claim 2 wherein the length of the receiver rail extends past the length of the radiused end.

4. The snap lock soffit system of claim 3 wherein at least one receiver tab depends from the receiver rail at a position further from the end fastening tab than the radiused end.

5. The snap lock soffit system of claim 1 further including an end hanger located the end of the receiver rail opposite to the end fastening tab, wherein the end hanger's width and height defines a third plane, where in the first plane and third plane are perpendicular to each other and the second plane and third plane are parallel to each other, the end hanger including at least one fastening hole.

6. The snap lock soffit system of claim 1 wherein the soffit panel further includes a frieze trim retainer groove.

7. The snap lock soffit system of claim 6 further including a frieze trim including a male snap end that mates with the frieze trim retainer groove and a decorative edge.

* * * * *